United States Patent [19]

Le Blanc

[11] 4,061,322

[45] Dec. 6, 1977

[54] JIG FOR ELECTRICAL CONDUIT STUBS

[76] Inventor: Mervin G. Le Blanc, 2405 Fazzio Road, Chalmette, La. 70043

[21] Appl. No.: 694,805

[22] Filed: June 10, 1976

[51] Int. Cl.[2] ..... B25B 1/20

[52] U.S. Cl. ..... 269/43; 269/321 S

[58] Field of Search ..... 269/43, 45, 99, 100, 269/287, 321 S; 249/207, 219 R

[56] References Cited

U.S. PATENT DOCUMENTS

| | | | |
|---|---|---|---|
| 2,679,872 | 6/1954 | Sutcliffe | 269/45 |
| 3,016,225 | 1/1962 | Hughes et al. | 249/207 |
| 3,160,175 | 12/1964 | Laemmle | 269/321 S |

*Primary Examiner*—Robert C. Watson

[57] ABSTRACT

A jig for electrical conduit stubs for use in construction work within the area in which a concrete slab is to be poured, locating said conduit stubs in proper linear and vertical relationship to a wall to be constructed above the concrete slab.

5 Claims, 4 Drawing Figures

JIG FOR ELECTRICAL CONDUIT STUBS

BACKGROUND OF THE INVENTION

Insofar as I am aware, in present day practice, stakes are driven or elbow type stakes are tied for use in positioning conduit stubs in order to support them in the approximate area in which a wall is to be constructed. After the concrete is poured and has hardened, the conduit stubs are shaped, extended or shortened, and then terminated by connecting with a junction box. This is a time consuming operation and is eliminated by use of my jig for conduit stubs. Much of the labor in the past involves the proper locating of the conduit stubs, as once the concrete hardens the location of said conduit stubs cannot be changed without breaking up the concrete. By use of my conduit stub jig and the method of positioning same, labor costs will be greatly reduced and accurate positioning of conduit stubs is assured.

BRIEF SUMMARY OF THE INVENTION

The jig for conduit stubs comprises a body in the form of a flanged channel with certain apertures punched in both ends of the flanges to be used for staking the jig. A plurality of spaced apertures are provided in the flanges intermediate the ends of the jig for receiving the conduit stubs. Separate or a composite cover can be provided over the conduit stubs to prevent entry of concrete during pouring.

To maintain the jig in position on the conduit stubs, set screws are provided in the web of the channel and by use of these set screws the jig can be secured in raised or lowered adjusted position.

When the area in which the slab is to be poured has been located, walls requiring electrical outlets are accurately determined and a string is tightly drawn along the proper face of the wall line at slab top level. At each location where an outlet is desired the conduit stub jig is placed against the line and tubular stakes are driven through the apertures provided in the jig. A pencil line is drawn on the stakes opposite the string to indicate the top of the slab, and elbow or bent conduits are inserted in the apertures after the conduit stub jig is slid upward and secured in adjusted position on the stakes by the set screws. Conduits can be fastened to conduit stub jigs by means of the set screw and the jigs are left in place until the concrete slab is poured and the walls are framed after which the jigs are removed for reuse.

DETAILED DESCRIPTION OF THE PREFERRED EMBODIMENTS

Figure 1:
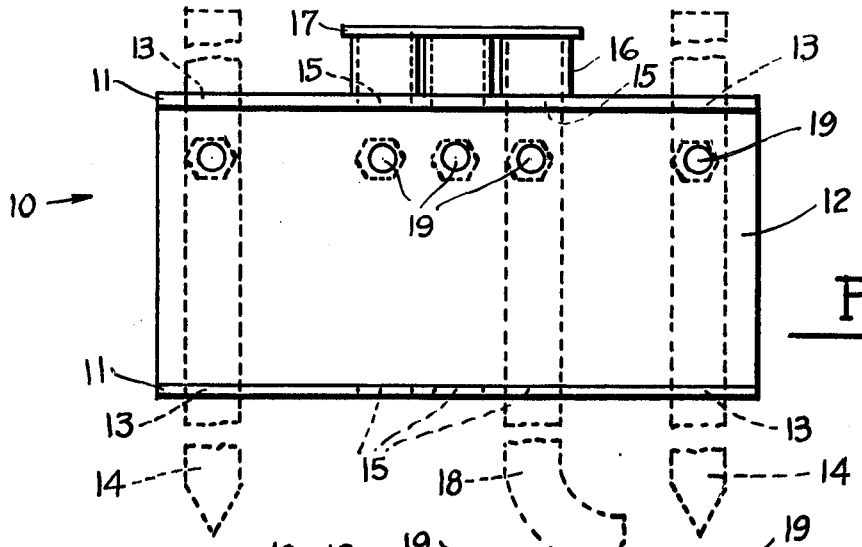
FIG. 1 is a front elevational view of the jig for conduit stubs.
Figure 2:
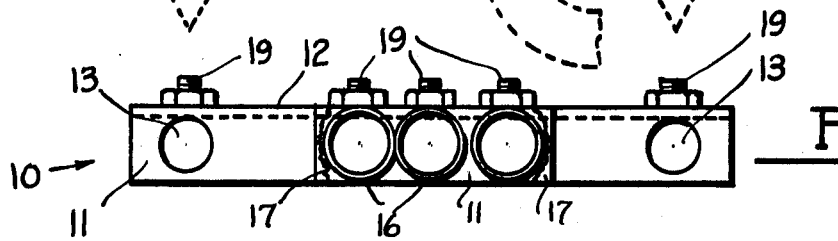
FIG. 2 is a top plan view of the same.
Figure 3:
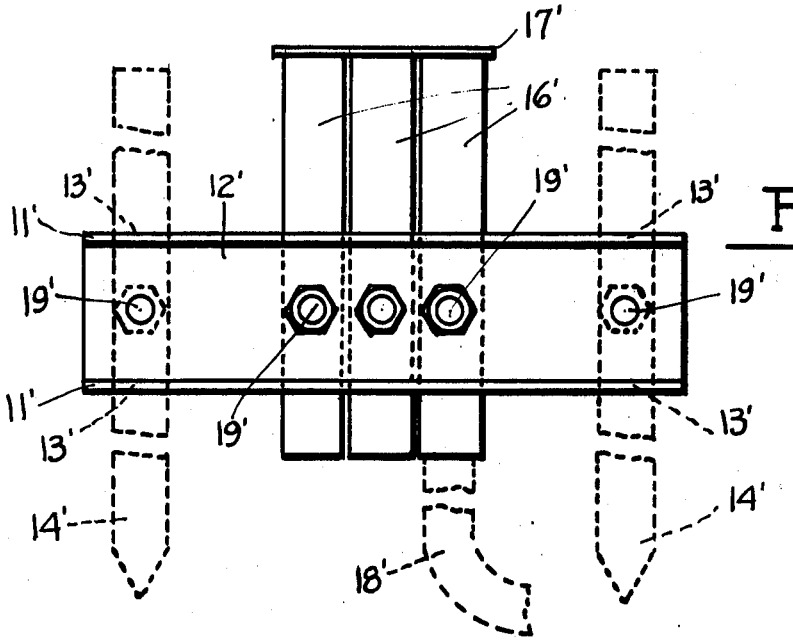
FIG. 3 is a front elevational view of a modified form of my jig for conduit stubs.
Figure 4:
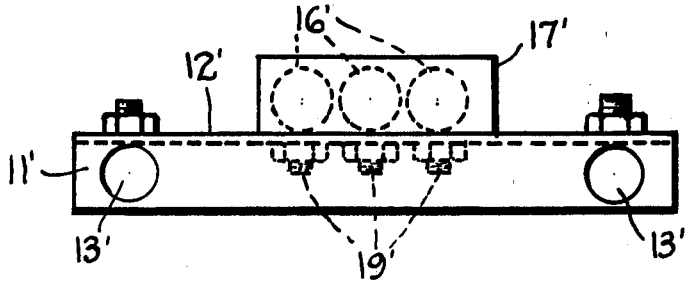
FIG. 4 is a top plan view of the same.

In the embodiment shown in FIGS. 1 and 2, the body of the conduit stub jig is formed of a channel 10 with flanges 11 and web 12. Apertures 13 are formed at the ends of the flanges 11 and are adapted to receive suitable stakes 14 which may be made of electrical tubing or any other suitable material, the jig being movable vertically on said stakes, the fastening of said stakes to the jig being described hereinafter.

A plurality of additional spaced apertures 15 are provided in flanges 11, intermediate the ends thereof, the upper apertures being provided with short guide tubes 16 with covers 17 to prevent entry of concrete when pouring. The lower apertures 15 may receive bent conduit ends or elbows 18 (or conduit stubups as known in the trade) shown in dotted lines, the latter eventually being buried in proper position in the poured concrete slab. These stubups may extend upwardly into the upper apertures and guide tubes 16.

Aligned with the apertures 13 and 15 adjacent the upper flange 11 are set screws 19, directly threaded in apertures in the web or in bosses affixed to the web. These set screws may be used to tighten against stakes 14 and against conduit ends 18 to hold the jig in adjusted position on the stakes and to hold the conduit ends in adjusted position in the jig.

In a modified form of my invention the body of the jig is smaller in cross sectional area than the frist form, also having flanges 11' and web 12', with apertures 13' in the flanges 11' located adjacent the ends thereof. A plurality of spaced guide tubes 16' are secured to the external surface of the web 12' and are capped by plates or covers 17'. Suitable set screws 19' pass through the web 12' and the wall of tubes 16' to make contact with the conduit ends or stubups 18' shown in dotted lines.

In the use of either form of jig, when the area in which the concrete slab is to be poured has been laid out, and walls in which electrical outlets will be located have been determined, and wall and outlet position marked by drawing a string across the face of the wall line at slab top level, the conduit stubup jig is placed against the line and tubular or other suitable stakes are inserted into the apertures 13 or 13' and driven into the surface to securely hold the jig in place. A pencil line is then marked on the stakes opposite the string to indicate the slab top and aid in correctly adjustably positioning said jig.

Once all of the jigs are in place, bent conduits are inserted in the apertures 15 or 15', and each jig is slid upwardly to the proper height and set screws 19 or 19' are tightened to hold the jig securely on the stakes 14 or 14' and to secure the bent conduits or stubups 18 or 18' in proper position in the jig. After the walls are framed the stubup jigs are removed for reuse and outlet boxes are attached to perfectly aligned conduit stubups.

From the foregoing it will be seen that I have provided a simple and inexpensive conduit stub jig for use in electrical construction work, facilitating the accurate locating of electrical conduit and receptacles or outlet boxes prior to pouring of concrete slabs, eliminating thereby the present complicated, inaccurate and tedious methods of locating such conduit and junction boxes.

It is obvious that changes in form, proportion and details of construction may be resorted to without departing from the spirit of my invention and I reserve all rights to such changes as fall within these specifications and the claims which follow.

I claim:

1. A conduit stubup jig comprising a channel shaped body, apertures adjacent the ends of said body in the flanges thereof, a plurality of spaced aligned apertures in the flanges of said body intermediate the ends thereof, stakes received in the first named apertures, conduit ends received in the second named apertures, fastening members securing the body of the jig to the stakes, and fastening members securing the conduit ends to the jig.

2. The conduit stubup jig of claim 1, including guides received in at least one set of the second named spaced apertures.

3. The conduit stubup jig of claim 1, said body including upper and lower flanges, and guides secured to the upper flange adjacent the second named spaced apertures.

4. The conduit stubup jig of claim 2, said guides having caps on the ends externally of the body of the jig.

5. A conduit stubup jig comprising a channel shaped body with opposing flanges and an intermediate web, apertures adjacent the ends of said body in the flanges thereof, a plurality of parallel spaced guides secured to the web of the body externally thereof, and intermediate the ends of said body, said first named apertures adapted to receive stakes therein, said spaced guides adapted to receive conduit ends therein, and fastening members securing the body member to the stakes, and fastening members securing the conduit members to the body of the jig.

* * * * *